US012716198B2

(12) United States Patent
Shinkai

(10) Patent No.: US 12,716,198 B2
(45) Date of Patent: Aug. 25, 2026

(54) EXCAVATOR

(71) Applicant: SUMITOMO CONSTRUCTION MACHINERY CO., LTD., Tokyo (JP)

(72) Inventor: Kazuma Shinkai, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 33 days.

(21) Appl. No.: 18/899,310

(22) Filed: Sep. 27, 2024

(65) Prior Publication Data

US 2025/0019933 A1 Jan. 16, 2025

Related U.S. Application Data

(63) Continuation of application No. PCT/JP2023/011745, filed on Mar. 24, 2023.

(30) Foreign Application Priority Data

Mar. 31, 2022 (JP) ..... 2022-061043

(51) Int. Cl.

| | |
|---|---|
| ***E02F 9/20*** | (2006.01) |
| ***E02F 3/32*** | (2006.01) |
| ***E02F 9/22*** | (2006.01) |
| ***E02F 9/24*** | (2006.01) |
| ***E02F 9/26*** | (2006.01) |

(52) U.S. Cl.

CPC ..... *E02F 9/205* (2013.01); *E02F 9/24* (2013.01); *E02F 9/26* (2013.01); *E02F 9/261* (2013.01); *E02F 3/32* (2013.01); *E02F 9/2228* (2013.01); *E02F 9/2285* (2013.01); *E02F 9/2292* (2013.01); *E02F 9/2296* (2013.01)

(58) Field of Classification Search

CPC ..... E02F 9/2292; E02F 9/2285; E02F 9/2228; E02F 3/32; E02F 9/261; E02F 9/24; E02F 9/205

USPC ..... 701/1

See application file for complete search history.

(56) References Cited

U.S. PATENT DOCUMENTS

| | | | | |
|---|---|---|---|---|
| 2014/0222247 | A1* | 8/2014 | Friend | G05D 1/0276 701/2 |
| 2017/0089044 | A1* | 3/2017 | Chitty | G01M 5/0033 |
| 2018/0002899 | A1* | 1/2018 | Morimoto | E02F 3/43 |
| 2018/0143625 | A1* | 5/2018 | Nelson | G05B 19/042 |
| 2018/0328003 | A1* | 11/2018 | Tsukamoto | E02F 9/2242 |
| 2019/0309500 | A1* | 10/2019 | Horii | E02F 9/20 |
| 2020/0291614 | A1* | 9/2020 | Kiyota | B60R 1/23 |
| 2020/0399857 | A1* | 12/2020 | Yamamoto | E02F 9/26 |

(Continued)

FOREIGN PATENT DOCUMENTS

| | | |
|---|---|---|
| WO | 2018/117176 | 6/2018 |
| WO | 2019/187519 | 10/2019 |
| WO | 2021/186517 | 9/2021 |

OTHER PUBLICATIONS

International Search Report for PCT/JP2023/011745 mailed on May 9, 2023.

*Primary Examiner* — Yazan A Soofi

(74) *Attorney, Agent, or Firm* — IPUSA, PLLC

(57) ABSTRACT

An excavator includes an upper turning body; a lower traveling body; and a control part. The control part is configured to permit changing of a parameter relating to control of the excavator by a remote operation from a management apparatus. The management apparatus is an apparatus that is configured to manage the excavator.

14 Claims, 8 Drawing Sheets

(56) References Cited

U.S. PATENT DOCUMENTS

| | | | | |
|---|---|---|---|---|
| 2022/0018096 | A1* | 1/2022 | Nishi | G06N 3/0464 |
| 2022/0100212 | A1* | 3/2022 | Fukuda | E02F 9/261 |

* cited by examiner

EXCAVATOR

CROSS-REFERENCE TO RELATED APPLICATIONS

The present application is a continuation application of International Application No. PCT/JP2023/011745 filed on Mar. 24, 2023, which is based on and claims priority to Japanese Patent Application No. 2022-061043 filed on Mar. 31, 2022. The contents of these applications are incorporated herein by reference.

BACKGROUND

1. Technical Field

The present invention relates to an excavator.

2. Description of the Related Art

In a conventional excavator, it is known that the operating speed of a hydraulic actuator is set according to an operator's operation of an operation input device of the excavator.

SUMMARY

According to an embodiment of the present invention, there is provided an excavator including an upper turning body; a lower traveling body; and a control part configured to permit changing of a parameter relating to control of the excavator by a remote operation from a management apparatus managing the excavator.

DETAILED DESCRIPTION

In the above-described conventional technology, in the case of changing a setting that is not permitted to be changed by an operator, it is necessary for a service person or the like who manages an excavator to go to an excavator work site or the like to change the setting, which is burdensome.

Therefore, it is desirable to easily change the setting.

Figure 1:
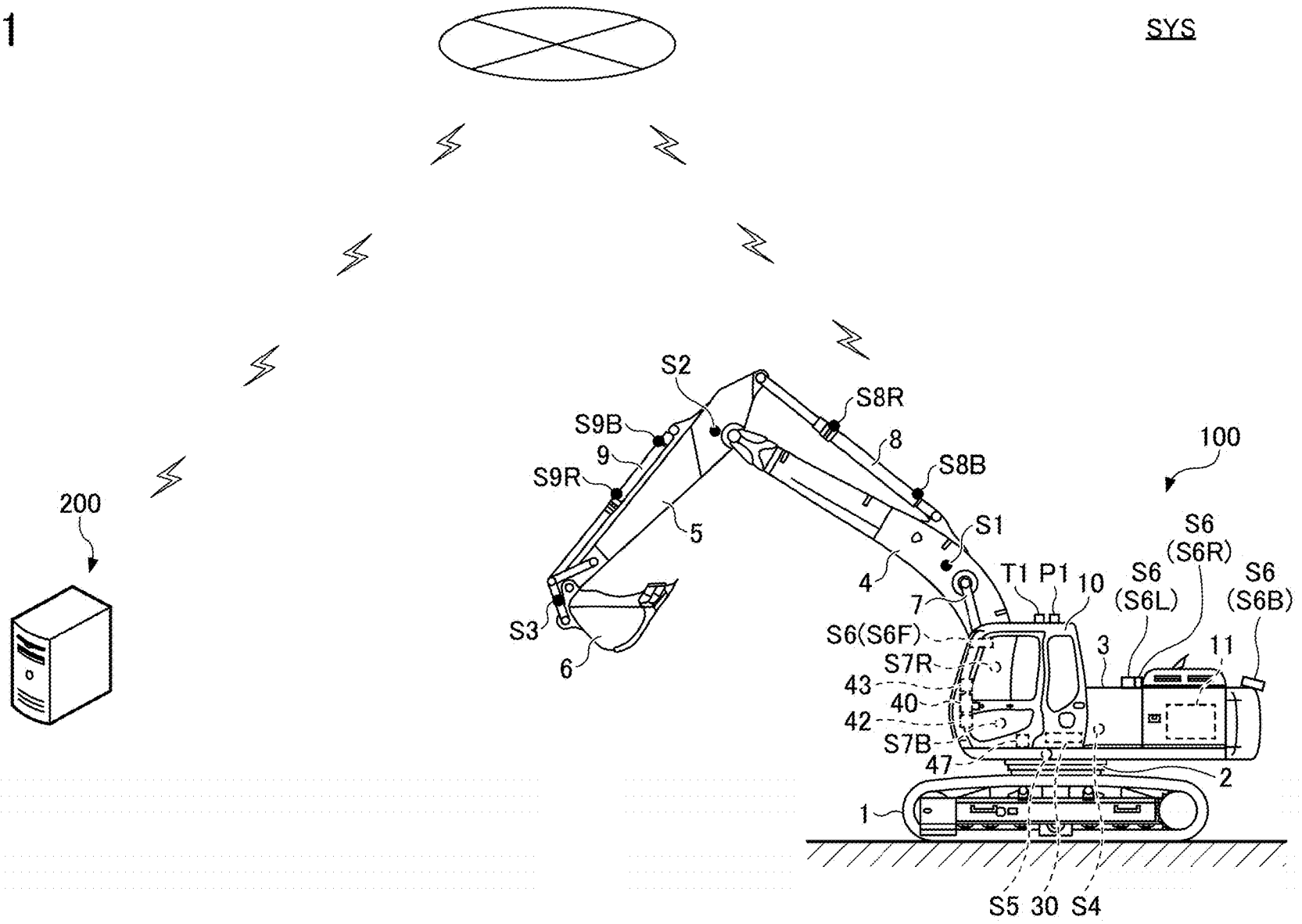
FIG. 1 is a diagram illustrating an example of a system configuration of an excavator management system.

An excavator management system of the present embodiment will be described below with reference to the drawings. FIG. 1 is a diagram illustrating an example of a system configuration of an excavator management system. In the present embodiment, an excavator 100 will be described as an example of a construction machine.

A management system SYS of the excavator of the present embodiment includes an excavator 100 and a management apparatus 200. In the following description, the management system SYS of construction machine is simply referred to as a management system SYS.

In the management system SYS of the present embodiment, the excavator 100 and the management apparatus 200 are connected via a network or the like. In addition to the excavator 100 and the management apparatus 200, the management system SYS of the present embodiment may include a support apparatus for supporting the excavator 100.

The excavator 100 of the present embodiment acquires operation information indicating the operation status of the excavator 100, transmits the operation information to the management apparatus 200, and receives various types of information from the management apparatus 200.

Specifically, the operation information of the excavator 100 includes position information indicating the current position of the excavator, orientation information indicating the orientation of the excavator, posture information indicating the posture of the excavator, work content information indicating the work content, load rate information indicating the load rate, cumulative time information indicating the cumulative time of the operation time, fuel information including the fuel injection amount, the $CO_2$ emission amount, the work amount, or the like.

Further, in the excavator 100 of the present embodiment, various items related to the control of the excavator 100 are set or changed.

The setting of various items related to the control of the excavator 100 in the present embodiment means that item values are associated with various items related to the control of the excavator 100 and are stored in the excavator 100.

The changing of settings of various items related to the control of the excavator 100 in the present embodiment means changing the item values associated with various items related to the control of the excavator 100. In the following description of the present embodiment, item values of various items related to the control of the excavator 100 may be expressed as parameters.

The various items related to the control of the excavator 100 in the present embodiment include items for which settings are permitted to be changed by an operator or the like operating the excavator 100 and items for which settings are permitted to be changed only by a service person (manager) managing the excavator 100.

In the following description, an item whose setting is permitted to be changed by an operator may be referred to as a worker item. In the following description, an item whose setting is permitted to be changed only by a service person (manager) may be referred to as a manager item. Details of the manager item will be described later.

In the excavator 100 of the present embodiment, when the setting of the manager item is to be changed, the setting of the manager item is changed by remote control from the management apparatus 200. Specifically, upon receiving an instruction to change the setting of the manager item from the management apparatus 200 via the network, the excavator 100 changes the item value (parameter) associated with the manager item in accordance with the instruction to change the setting.

In the present embodiment, because the setting of the manager item can be changed by remote control from the management apparatus 200 as described above, it is not necessary for a manager such as a service person to go to the work site of the excavator 100 to change the setting of the manager item, and the setting can be easily changed.

Further, the excavator 100 of the present embodiment may specify a period during which each actuator operation is stopped while the engine is being driven in a period during which the work is stopped.

The period in which the excavator 100 is in a state in which the work is stopped includes a period in which the engine is stopped in addition to a period in which the actuator operations are stopped (an idle state period) while the engine is driven. The state in which the actuator operations of the excavator 100 are stopped includes a state in which the engine 11 as the prime mover of the excavator 100 is turned on and no lever operation is performed, and a state in which the engine 11 is turned off.

Note that an electric motor may be used as the prime mover without using an engine. In this case, an electric storage device is also mounted to supply electric power to the electric motor. The electric storage device is a device for storing electric power, and is, for example, an electric double-layer capacitor, a lithium-ion battery, a nickel-metal hydride battery, or the like. In this case, the excavator 100 controls the electric motor by using an inverter, so that the main pump 14 (see FIG. 2) is driven to rotate by the electric power stored in the electric storage device.

The management apparatus 200 of the present embodiment receives operation information from the excavator 100, and aggregates the operation information for each work content of the excavator 100 indicated by the state information included in the operation information.

Further, the management apparatus 200 of the present embodiment requests the excavator 100 to approve the change of the setting of the manager item, and when the excavator 100 approves this request, the management apparatus 200 transmits an instruction to change the setting of the manager item to the excavator 100 via the network.

In the example of FIG. 1, the management apparatus 200 is implemented by one information processing apparatus, but the present invention is not limited thereto. The management apparatus 200 may be implemented by a plurality of information processing apparatuses. That is, the function implemented by the management apparatus 200 may be implemented by a plurality of information processing apparatuses.

Next, the configuration of the excavator 100 of the present embodiment will be described. FIG. 1 illustrates a side view of the excavator 100.

The excavator 100 has a lower traveling body 1, a turning mechanism 2, and an upper turning body 3. In the excavator 100, the upper turning body 3 is rotatably mounted on the lower traveling body 1 via the turning mechanism 2. A boom 4 is attached to the upper turning body 3. An arm 5 is attached to the tip of the boom 4, and a bucket 6 as an end attachment is attached to the tip of the arm 5.

The boom 4, the arm 5, and the bucket 6 constitute an excavation attachment as an example of an attachment. The boom 4 is driven by a boom cylinder 7, the arm 5 is driven by an arm cylinder 8, and the bucket 6 is driven by a bucket cylinder 9. A boom angle sensor S1 is attached to the boom 4, an arm angle sensor S2 is attached to the arm 5, and a bucket angle sensor S3 is attached to the bucket 6.

The boom angle sensor S1 is configured to detect the rotation angle of the boom 4. In the present embodiment, the boom angle sensor S1 is an acceleration sensor, and can detect the rotation angle (hereinafter, referred to as a "boom angle") of the boom 4 with respect to the upper turning body 3. The boom angle, for example, becomes a minimum angle when the boom 4 is lowered to the maximum, and becomes larger as the boom 4 is raised.

The arm angle sensor S2 is configured to detect the angle of rotation of the arm 5. In the present embodiment, the arm angle sensor S2 is an acceleration sensor and can detect the angle of rotation (hereinafter, referred to as an "arm angle") of the arm 5 with respect to the boom 4. The arm angle has a minimum angle when the arm 5 is fully closed, for example, and increases as the arm 5 is opened.

The bucket angle sensor S3 is configured to detect the angle of rotation of the bucket 6. In the present embodiment, the bucket angle sensor S3 is an acceleration sensor and can detect the angle of rotation (hereinafter, referred to as a "bucket angle") of the bucket 6 with respect to the arm 5. The bucket angle has a minimum angle when the bucket 6 is fully closed, for example, and increases as the bucket 6 is opened.

The boom angle sensor S1, the arm angle sensor S2, and the bucket angle sensor S3 may each be a potentiometer using a variable resistor, a stroke sensor for detecting the stroke of the corresponding hydraulic cylinder, a rotary encoder for detecting the angle of rotation around the connecting pin, a gyro sensor, or a combination of an acceleration sensor and a gyro sensor.

A boom rod pressure sensor S7R and a boom bottom pressure sensor S7B are attached to the boom cylinder 7. An arm rod pressure sensor S8R and an arm bottom pressure sensor S8B are attached to the arm cylinder 8.

A bucket rod pressure sensor S9R and a bucket bottom pressure sensor S9B are attached to the bucket cylinder 9. The boom rod pressure sensor S7R, the boom bottom pressure sensor S7B, the arm rod pressure sensor S8R, the arm bottom pressure sensor S8B, the bucket rod pressure sensor S9R, and the bucket bottom pressure sensor S9B are also collectively referred to as "cylinder pressure sensors".

The boom rod pressure sensor S7R detects the pressure (hereinafter, referred to as "boom rod pressure") in the rod-side oil chamber of the boom cylinder 7, and the boom bottom pressure sensor S7B detects the pressure (hereinafter, referred to as "boom bottom pressure") in the bottom-side oil chamber of the boom cylinder 7. The arm rod pressure sensor S8R detects the pressure (hereinafter, referred to as "arm rod pressure") in the rod-side oil chamber of the arm cylinder 8, and the arm bottom pressure sensor S8B detects the pressure (hereinafter, referred to as "arm bottom pressure") in the bottom-side oil chamber of the arm cylinder 8.

The bucket rod pressure sensor S9R detects the pressure (hereinafter, referred to as "bucket rod pressure") in the rod-side oil chamber of the bucket cylinder 9, and the bucket bottom pressure sensor S9B detects the pressure (hereinafter, referred to as "bucket bottom pressure") in the bottom-side oil chamber of the bucket cylinder 9.

The upper turning body 3 is provided with both a cabin 10 serving as an operator's cabin and a power source such as an engine 11. A sensor for detecting the amount of $CO_2$ emissions may be provided in the vicinity of the exhaust mechanism of the engine 11.

Further, the upper turning body 3 is provided with a controller 30, a display device 40, an operation part 42, an audio output device 43, a storage device 47, a positioning device P1, a machine body inclination sensor S4, a turning angular speed sensor S5, an imaging device S6, and a communication device T1.

The upper turning body 3 may be provided with a power storage part for supplying power, a motor-generator for generating power using the rotational driving force of the engine 11, or the like. The power storage part may be, for example, a capacitor, a lithium-ion battery, or the like. The motor-generator may function as a motor to drive a mechanical load, or may function as a generator to supply power to the electric load.

The controller 30 functions as a main control part for controlling the drive of the excavator 100. In the present embodiment, the controller 30 is configured by a computer including a CPU (Central Processing Unit), RAM (Random Access Memory), ROM (Read Only Memory), or the like. The various functions of the controller 30 are implemented, for example, by the CPU executing a program stored in the ROM. The various functions may include, for example, at least one of a machine guidance function for guiding the manual operation of the excavator 100 by the operator or a machine control function for automatically supporting the manual operation of the excavator 100 by the operator.

The controller 30 may store various items related to the control of the excavator 100 in association with item values. That is, the controller 30 may store the settings of various items related to the control of the excavator 100. In the controller 30, items for which settings are stored include worker items and manager items.

In the present embodiment, information in which various items related to the control of the excavator 100 are associated with item values may be expressed as setting information. All or part of the setting information may be stored in a memory device included in the controller 30, or may be stored in a storage device 47 provided outside the controller 30.

The display device 40 is configured to display various kinds of information. The display device 40 may be connected to the controller 30 via a communication network such as a CAN, or may be connected to the controller 30 via an exclusive-use line.

The operation part 42 is configured to allow the operator to input various kinds of information to the controller 30. The operation part 42 includes at least one of a touch panel, a knob switch, a membrane switch, or the like installed in the cabin 10.

The audio output device 43 is configured to output audio. The audio output device 43 may be, for example, an on-vehicle speaker connected to the controller 30 or an alarm such as a buzzer. In the present embodiment, the audio output device 43 is configured to output various kinds of information in audio in response to an audio output instruction from the controller 30.

The storage device 47 is configured to store various kinds of information. The storage device 47 is, for example, a nonvolatile storage medium such as a semiconductor memory. The storage device 47 may store information output by various kinds of devices during the operation of the excavator 100, or may store information acquired via various kinds of devices before the operation of the excavator 100 is started.

The storage device 47 may store, for example, data regarding the target work surface acquired via the communication device T1 or the like. The target work surface may be set by the operator of the excavator 100 or may be set by a construction manager or the like.

The positioning device P1 may be configured to measure the position of the upper turning body 3. The positioning device P1 may be configured to measure the orientation of the upper turning body 3. In the present embodiment, the positioning device P1 is a GNSS compass, for example, and detects the position and orientation of the upper turning body 3, and outputs the detected value to the controller 30. Therefore, the positioning device P1 may also function as an orientation detection device for detecting the orientation of the upper turning body 3. The orientation detection device may be an orientation sensor attached to the upper turning body 3.

The machine body inclination sensor S4 is configured to detect the inclination of the upper turning body 3. In the present embodiment, the machine body inclination sensor S4 is an acceleration sensor for detecting the longitudinal inclination angle around the longitudinal axis and the lateral inclination angle around the lateral axis of the upper turning body 3 with respect to the virtual horizontal plane. The longitudinal axis and the lateral axis of the upper turning body 3 are orthogonal to each other at an excavator center point which is a point on the pivot axis of the excavator 100, for example.

The turning angular speed sensor S5 is configured to detect the turning angular speed of the upper turning body 3. The turning angular speed sensor S5 may be configured to detect or calculate the turning angle of the upper turning body 3. In the present embodiment, the turning angular speed sensor S5 is a gyro sensor. The turning angular speed sensor S5 may be a resolver, a rotary encoder, or the like.

The imaging device S6 is an example of a space recognition apparatus, and is configured to acquire an image around the excavator 100. In the present embodiment, the imaging device S6 includes a front camera S6F for imaging the space in front of the excavator 100, a left camera S6L for imaging the space to the left of the excavator 100, a right camera S6R for imaging the space to the right of the excavator 100, and a rear camera S6B for imaging the space behind the excavator 100.

The imaging device S6 is, for example, a monocular camera having an imaging device such as a CCD or CMOS, and outputs a captured image to the display device 40. The imaging device S6 may be a stereo camera, a range image camera, or the like. The imaging device S6 may be replaced with another spatial recognition device such as a three-dimensional range image sensor, an ultrasonic sensor, a millimeter-wave radar, a LIDAR, or an infrared sensor, or a combination of another spatial recognition device and a camera.

The front camera S6F is, for example, mounted on the ceiling of the cabin 10, that is, inside the cabin 10. However, the front camera S6F may be mounted outside the cabin 10, such as on the roof of the cabin 10 or on the side of the boom 4. The left camera S6L is mounted on the left end of the upper surface of the upper turning body 3, the right camera S6R is mounted on the right end of the upper surface of the upper turning body 3, and the rear camera S6B is mounted on the rear end of the upper surface of the upper turning body 3.

The communication device T1 is configured to control communication with external devices located outside the excavator 100. In the present embodiment, the communication device T1 controls communication with external devices via a satellite communication network, a cellular phone communication network, an Internet network, or the like. The external devices are, for example, a management apparatus 200 such as a server installed in an external facility and a support apparatus such as a smartphone carried by workers around the excavator 100.

Figure 2:
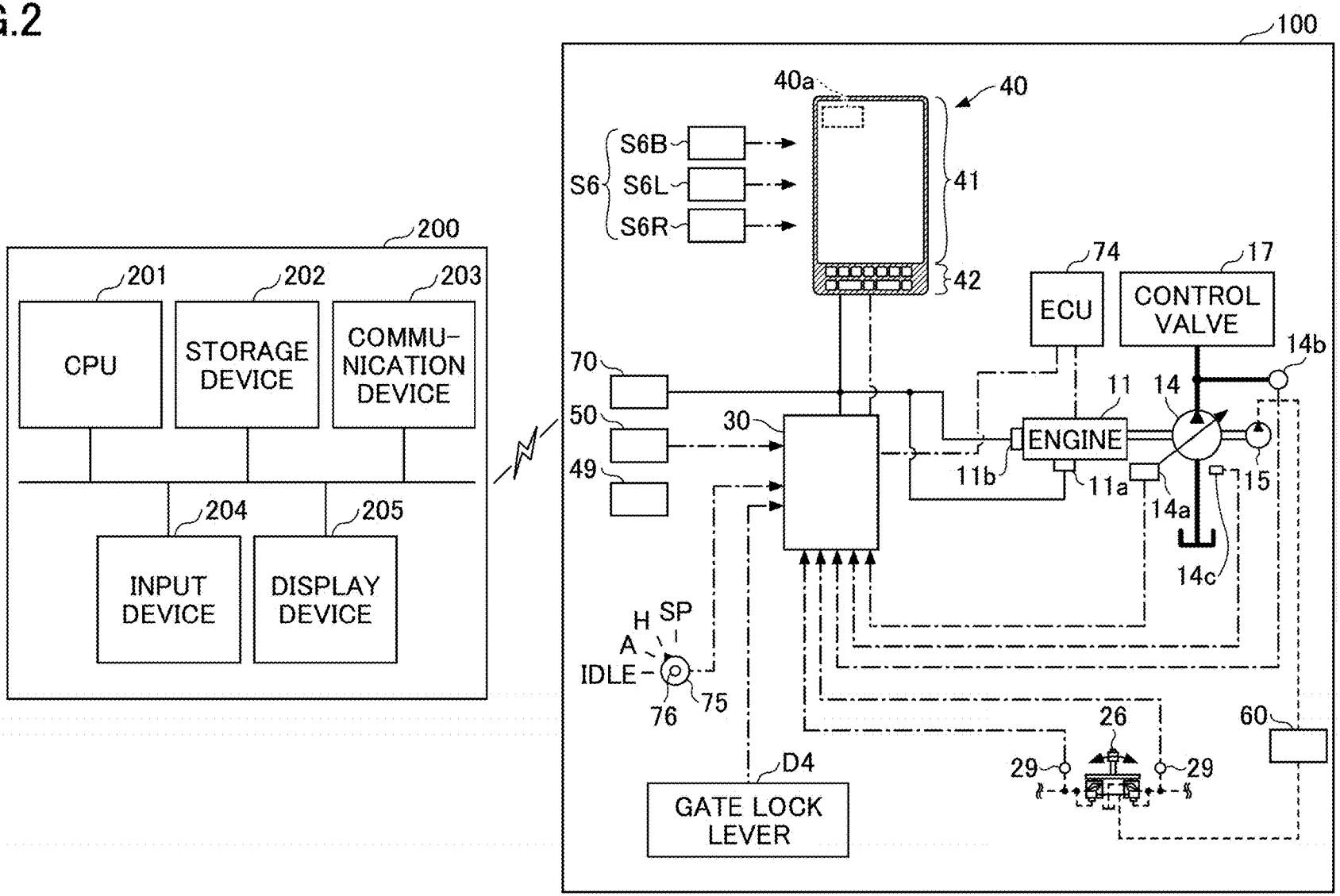
FIG. 2 is a diagram explaining a hardware configuration of each apparatus of an excavator management system.

Next, referring to FIG. 2, the hardware configuration of each apparatus included in the management system SYS will be described. FIG. 2 is a diagram for explaining the hardware configuration of each apparatus included in the management system of the excavator.

First, the basic system mounted on the excavator 100 will be described. In FIG. 2, the mechanical power transmission line is represented by a double line, the hydraulic oil line by a thick solid line, the pilot line by a dashed line, the power line by a thin solid line, and the electrical control line by a dash-dotted line.

As illustrated in FIG. 2, the basic system of the excavator 100 mainly includes an engine 11, a main pump 14, a pilot pump 15, a control valve 17, an operation device 26, an operation pressure sensor 29, a controller 30, a selector valve 60, a display device 40, an engine rotation speed adjustment dial 75, an output characteristic selector switch 76, or the like.

The engine 11 is a diesel engine adopting isochronous control for maintaining an engine rotation speed constant regardless of an increase or decrease in a load. Fuel injection quantity, fuel injection timing, boost pressure, or the like in the engine 11 are controlled by an engine control part (ECU 74).

The engine 11 is connected to a main pump 14 and a pilot pump 15 as hydraulic pumps, respectively. The main pump 14 is connected to a control valve 17 via a hydraulic oil line.

The control valve 17 is a hydraulic control device for controlling the hydraulic system of the excavator 100. The control valve 17 is connected to hydraulic actuators such as a left traveling hydraulic motor, a right traveling hydraulic motor, a boom cylinder 7, an arm cylinder 8, a bucket cylinder 9, and a turning hydraulic motor.

Specifically, the control valve 17 includes a plurality of spool valves corresponding to the respective hydraulic actuators. Each spool valve is configured to be displaceable according to the pilot pressure so that the opening area of the PC port and the opening area of the CT port can be increased or decreased. The PC port is a port for communicating the main pump 14 with the hydraulic actuator. The CT port is a port for communicating the hydraulic actuator with the hydraulic oil tank.

The pilot pump 15 is connected to the operation device 26 via a pilot line. The operation device 26 includes, for example, a left operating lever, a right operating lever, and a travel operation device. The travel operation device includes, for example, a travel lever and a travel pedal. In the present embodiment, each of the operation device 26 is a hydraulic operation device and is connected via a pilot line to a pilot port of a corresponding spool valve in the control valve 17. However, the operation device 26 may be an electric operation device.

The operation pressure sensor 29 detects the operation contents of the operation device 26 in the form of pressure. The operation pressure sensor 29 outputs a detection value to the controller 30. However, the operation contents of the operation device 26 may be electrically detected.

The selector valve 60 is configured to switch between an enabled state and an disabled state of the operation device 26. The enabled state of the operation device 26 is a state in which an operator can operate the hydraulic actuator by using the operation device 26. The disabled state of the operation device 26 is a state in which an operator cannot operate the hydraulic actuator by using the operation device 26. In the present embodiment, the selector valve 60 is a gate lock valve configured to operate in response to an instruction from the controller 30.

Specifically, the selector valve 60 is arranged in a pilot line connecting the pilot pump 15 and the operation device 26, and is configured to switch the shut-off/communication of the pilot line in response to an instruction from the controller 30. The operation device 26 is in an enabled state when, for example, the gate lock lever D4 is pulled up and the selector valve 60 (gate lock valve) is opened, and is in an disabled state when the gate lock lever D4 is pushed down and the selector valve 60 (gate lock valve) is closed.

The display device 40 is configured to display various kinds of information. The display device 40 may be connected to the controller 30 via a communication network such as CAN, or may be connected to the controller 30 via an exclusive-use line. In the present embodiment, the display device 40 is configured to display one or two or more captured images captured by the imaging device S6 and a menu screen. The display device 40 is operated by receiving power from the storage battery 70. The display device 40 includes a control part 40*a*, an image display part 41, and an operation part 42.

The control part 40*a* controls images displayed on the image display part 41. In the present embodiment, the control part 40*a* is configured by a computer including a CPU, a RAM, a NVRAM, a ROM, or the like. In this case, the control part 40*a* reads the program corresponding to each functional element from the ROM, loads the program into the RAM, and causes the CPU to execute the corresponding processing. However, each functional element may be configured by hardware or a combination of software and hardware. The image displayed on the image display part 41 may be controlled by the controller 30 or the imaging device S6.

The image display part 41 displays a captured image captured by at least one of the imaging devices S6 and a menu screen. The captured image may be, for example, a rear image captured by the rear camera S6B, a left image captured by the left camera S6L, or a right image captured by the right camera S6R. The captured image may be, for example, a bird's eye image obtained by combining captured images captured by the rear camera S6B, the left camera S6L, and the right camera S6R. The captured image may be two or more images selected from a rear image, a left image, a right image, and a bird's eye image. The menu screen includes a state screen illustrating the state of the excavator 100 and a setting screen illustrating various settings of the excavator 100.

The operation part 42 is a switch panel including hardware switches. The operation part 42 may be a touch panel. In the present embodiment, the operation part 42 is arranged below the image display part 41 and includes a switch (for example, a menu switch) for changing the image displayed by the image display part 41. However, the arrangement of the operation part 42 is not limited to the example described above, and may be arranged on an operating lever, for example, or on a seat left console or seat right console on both left and right sides of the driver's seat. In addition to the operation part 42 provided in the display device 40, the driver's seat side operation part 50 having the same function as the operation part 42 may be arranged on at least one of the operating lever, seat left console, or seat right console.

In the present embodiment, the image display part 41 displays a menu screen when the menu switch of the operation part 42 is operated in a state in which the bird's eye image FV and the rear image CBT captured by the imaging device S6 are displayed. For example, the image display part 41 reduces the size of the rear image CBT without changing the size of the bird's eye image FV before and after the menu switch of the operation part 42 is operated, and displays a screen for selecting a menu detailed item. When a predetermined switch of the operation part 42 is operated in a state in which the screen for selecting a menu detailed item is displayed, the image display part 41 switches the rear image CBT to a menu screen such as a state screen illustrating the state of the excavator 100 and a setting screen indicating various settings of the excavator 100. At this time, the image display part 41 displays the bird's eye image FV in a state in which the size is maintained without changing the size.

The image display part 41 may be configured to display a menu screen when the menu switch of the operation part 42 is operated, regardless of whether the excavator 100 is operable or inoperable. The image display part 41 may be configured to display a menu screen when the menu switch of the operation part 42 is operated only when the excavator 100 is inoperable.

Further, these may be configured to be switchable by a switching means such as a switching switch. The operable state of the excavator 100 is, for example, a state in which the operation device 26 is enabled when the gate lock lever D4 is pulled up and the selector valve 60 is opened. The inoperable state of the excavator 100 is, for example, a state in which the operation device 26 is disabled when the gate lock lever D4 is pushed down and the selector valve 60 is closed.

The storage battery 70 is charged by, for example, electricity generated by an alternator 11*a*. The electric power of the storage battery 70 is also supplied to the controller 30 or the like. For example, the starter 11*b* of the engine 11 is driven by electric power from the storage battery 70 to start the engine 11.

The ECU 74 transmits data on the state of the engine 11, such as the cooling water temperature, to the controller 30. The regulator 14*a* of the main pump 14 transmits data on the swash plate tilt angle to the controller 30. The discharge pressure sensor 14*b* transmits data on the discharge pressure of the main pump 14 to the controller 30. The oil temperature sensor 14*c* provided in the conduit between the hydraulic oil tank and the main pump 14 transmits data on the temperature of the hydraulic oil flowing in the conduit to the controller 30. The operation pressure sensor 29 transmits data on the pilot pressure generated when the operation device 26 is operated to the controller 30. The controller 30 stores these pieces of data in a temporary storage part (memory) and can transmit the data to the display device 40 when necessary.

The engine rotation speed adjustment dial 75 is a dial for adjusting the rotation speed of the engine 11. The engine rotation speed adjustment dial 75 transmits data on the setting state of the engine rotation speed to the controller 30. The engine rotation speed adjustment dial 75 is configured so that the engine rotation speed can be switched in four levels, namely, an SP mode, an H mode, an A mode, and an IDLE mode.

The SP mode is a rotation speed mode selected when priority is given to the amount of work, and the highest engine rotation speed is used. The H mode is a rotation speed mode selected when both the amount of work and the fuel mileage are desired, and the second highest engine rotation speed is used. The A mode is a rotation speed mode selected when it is desired to operate the excavator 100 with low noise while prioritizing the fuel mileage, and the third highest engine rotation speed is used.

The IDLE mode is a rotation speed mode selected when it is desired to idle the engine 11, and the lowest engine rotation speed is used. The engine 11 is controlled so as to be constant at the engine rotation speed corresponding to the rotation speed mode set by the engine rotation speed adjustment dial 75. The engine rotation speed adjustment dial 75 is provided with an output characteristic selector switch 76, and the output characteristic of the excavator 100 can be changed by pressing the output characteristic selector switch 76. In the output characteristic selector switch 76, for example, the engine output torque diagram may be changed, or the engine rotation speed in each stage of the engine rotation speed adjustment dial 75 may be decreased by a predetermined value.

The alarm device 49 is a device used to alert people involved in the work of the excavator 100. The alarm device 49 is configured by, for example, a combination of an indoor alarm device and an outdoor alarm device. The indoor alarm device is a device for calling the attention of an operator of the excavator 100 in the cabin 10, and includes, for example, at least one of a sound output device, a vibration generating device, or a light emitting device provided in the cabin 10. The indoor alarm device may be the display device 40.

The outdoor alarm device is a device for calling the attention of a worker working around the excavator 100, and includes, for example, at least one of a sound output device or a light emitting device provided outside the cabin 10. The sound output device as the outdoor alarm device includes, for example, a travel alarm device attached to the bottom surface of the upper turning body 3. The outdoor alarm device may be a light emitting device provided on the upper turning body 3. However, the outdoor alarm device may be omitted. The alarm device 49 may, for example, notify a person engaged in the work of the excavator 100 when the imaging device S6 functioning as an object detection device detects a predetermined object.

Next, the hardware configuration of the management apparatus 200 of the present embodiment will be described. The management apparatus 200 of the present embodiment is a computer having a CPU 201, a storage device 202, a communication device 203, an input device 204, and a display device 205, which are connected to each other by a bus.

The CPU 201 controls the entire operation of the management apparatus 200. The storage device 202 stores a program executed by the CPU 201, various kinds of information related to the excavator 100, or the like. The communication device 203 communicates with the excavator 100 and the support apparatus via a network.

The input device 204 is for inputting information to the management apparatus 200, and is implemented by, for example, a keyboard or a pointing device. The display device 205 is for displaying various kinds of information output from the management apparatus 200, and is implemented by a display or the like.

Figure 3:
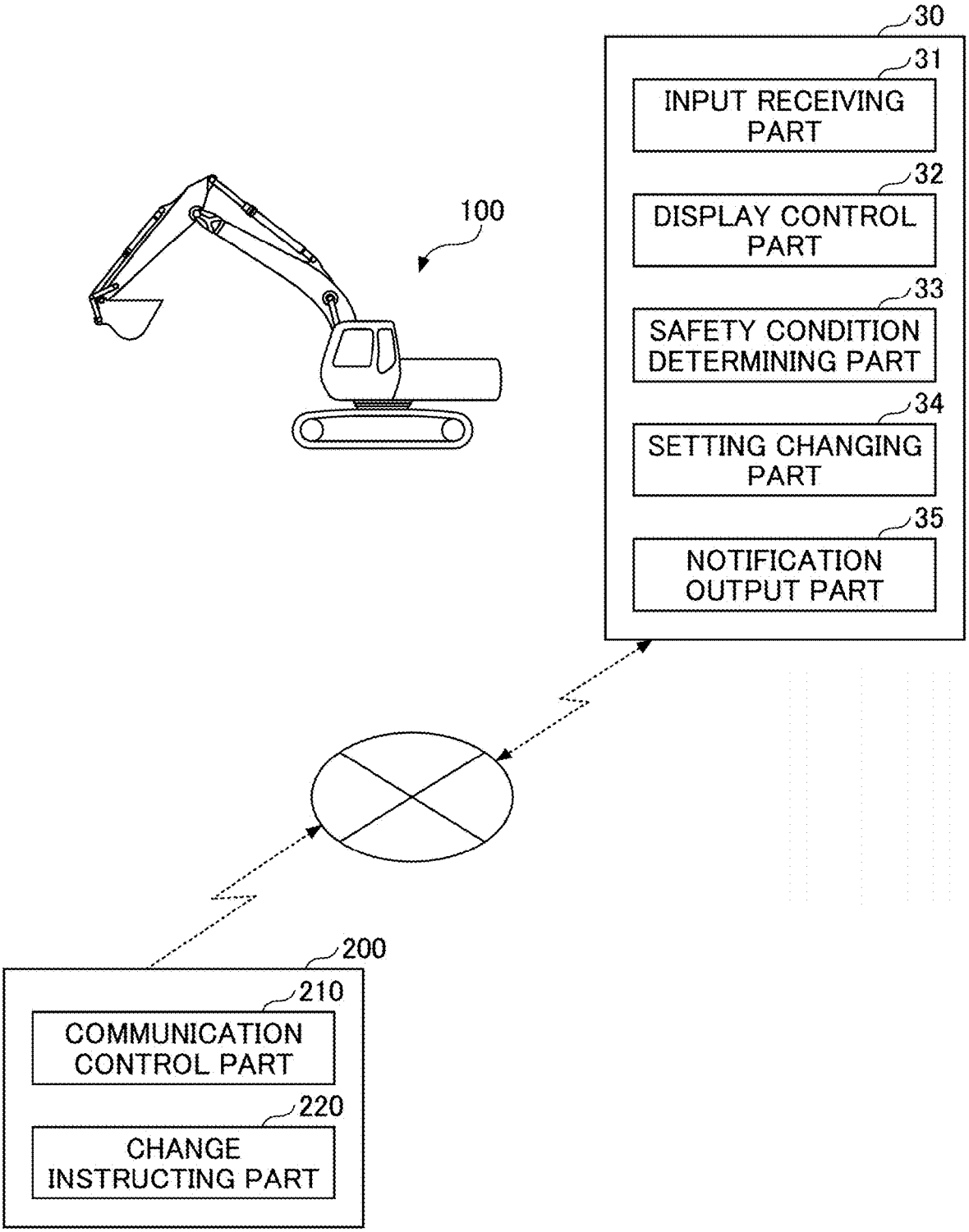
FIG. 3 is a diagram explaining a function of each apparatus of an excavator management system.

Next, the functions of the apparatuses of the management system SYS according to the present embodiment will be described with reference to FIG. 3. FIG. 3 is a diagram for explaining the functions of the apparatuses of the management system of the excavator.

First, the functions of the excavator 100 will be described. The following elements are implemented by the controller 30 of the excavator 100 reading and executing a program stored in a memory device. The excavator 100 of the present embodiment includes an input receiving part 31, a display control part 32, a safety condition determining part 33, a setting changing part 34, and a notification output part 35.

The input receiving part 31 receives various inputs to the excavator 100. More specifically, for example, the input receiving part 31 receives an input of a request or instruction transmitted from the management apparatus 200 to the excavator 100.

The display control part 32 controls the display on the display device 40. The safety condition determining part 33 determines whether the state of the excavator 100 satisfies the safety condition.

The safety condition of the present embodiment will be described below. The safety condition in the present embodiment is that the gate lock lever D4 is pressed down to disable the operation device 26 and that the engine 11 is turned off. That is, the safety condition in the present embodiment is that it is ensured that the excavator 100 does not start moving (is not in operation).

Therefore, the safety condition determining part 33 of the present embodiment determines whether the operation device 26 of the excavator 100 is disabled and the engine 11 is turned off, and determines that the safety condition is satisfied when the operation device 26 is disabled and the engine 11 is turned off.

The safety condition of the present embodiment may satisfy any one of a state in which the gate lock lever D4 is pressed down to disable the operation device 26, a state in which the engine 11 is turned off, and a state in which the operating lever included in the operation device 26 is in neutral.

The setting changing part 34 changes the setting of the manager item in response to a setting change instruction transmitted from the management apparatus 200. In the present embodiment, the setting change instruction transmitted from the management apparatus 200 may include the manager item to be changed and the changed item value of the manager item.

Upon receiving the change instruction, the setting changing part 34 identifies the manager item to be changed from the setting information stored in the controller 30, and updates (overwrites) the item value of the identified manager item to the item value after the change.

The notification output part 35 outputs various notifications generated by the excavator 100. Specifically, when the state of the excavator 100 does not satisfy the safety condition, the notification output part 35 may output a notification indicating that fact to the management apparatus 200.

Next, the functions of the management apparatus 200 will be described. The management apparatus 200 of the present embodiment includes a communication control part 210 and a change instructing part 220.

The communication control part 210 of the present embodiment controls communication between the management apparatus 200 and the excavator 100. More specifically, the communication control part 210 transmits to the excavator 100 an approval request for changing the setting of the manager item, an instruction for changing the setting of the manager item, or the like to the excavator 100. The communication control part 210 receives an approval notification from the excavator 100 for approving the change of the setting of the manager item.

The change instructing part 220 of the present embodiment generates a change instruction for instructing the excavator 100 to change the settings of the manager item. The change instruction may be input to the management apparatus 200 by, for example, a manager (service person) who manages the excavator 100. The manager item to be changed in the settings and the changed item value may be predetermined between, for example, the operator of the excavator 100 and the service person.

The manager item of the present embodiment will now be described.

The manager item of the present embodiment is an item for which the change of the item value by the user of the excavator 100 is prohibited. The user of the excavator 100 is, for example, an operator who operates the excavator 100. The manager item of the present embodiment may be predetermined by a manager who manages the excavator 100. The manager of the excavator 100 may be a service person who has the authority to perform the maintenance of the excavator 100.

Specifically, the manager items of the present embodiment include, for example, items whose corresponding item values are numerical values and items whose corresponding item values are "enabled" or "disabled".

Among the manager items, items whose corresponding item values are numerical values include, for example, the maximum rotation speed of the engine 11, the minimum rotation speed of the engine 11 in the idling state, the rotation speed of the engine 11 when the IDLE mode is selected, the degree of luminance of the display device 40, or the like.

Items for which corresponding item values are numerical values include the speed balance of a turning operation when an operation to turn the upper turning body 3 is performed, and a boom-up operation when a lever operation to raise the boom 4 is performed.

Further, among the manager items, in an item whose corresponding item value is "enabled" or "disabled", enabled/disabled of the function indicated by the manager item is set.

The function indicated by the manager items, whose corresponding item value is "enabled" or "disabled", includes, for example, a function to automatically disable the operation device 26, a function to display a setting screen related to a specific setting, a function to output an alarm as a buzzer sound, or the like.

The function of automatically disabling the operation device 26 is a function of maintaining the disabled state of the operation lever when an operation of pulling up the gate lock lever D4 is performed in a state where the operation lever is in a state of lever input.

The function of displaying a setting screen related to a specific setting is a function of displaying a setting screen for setting a pressure value of a reserve line used when the end attachment is used as an end attachment other than the bucket 6.

The items included in the manager items are not limited to the items described above and may include items other than the items described above.

Figure 4:
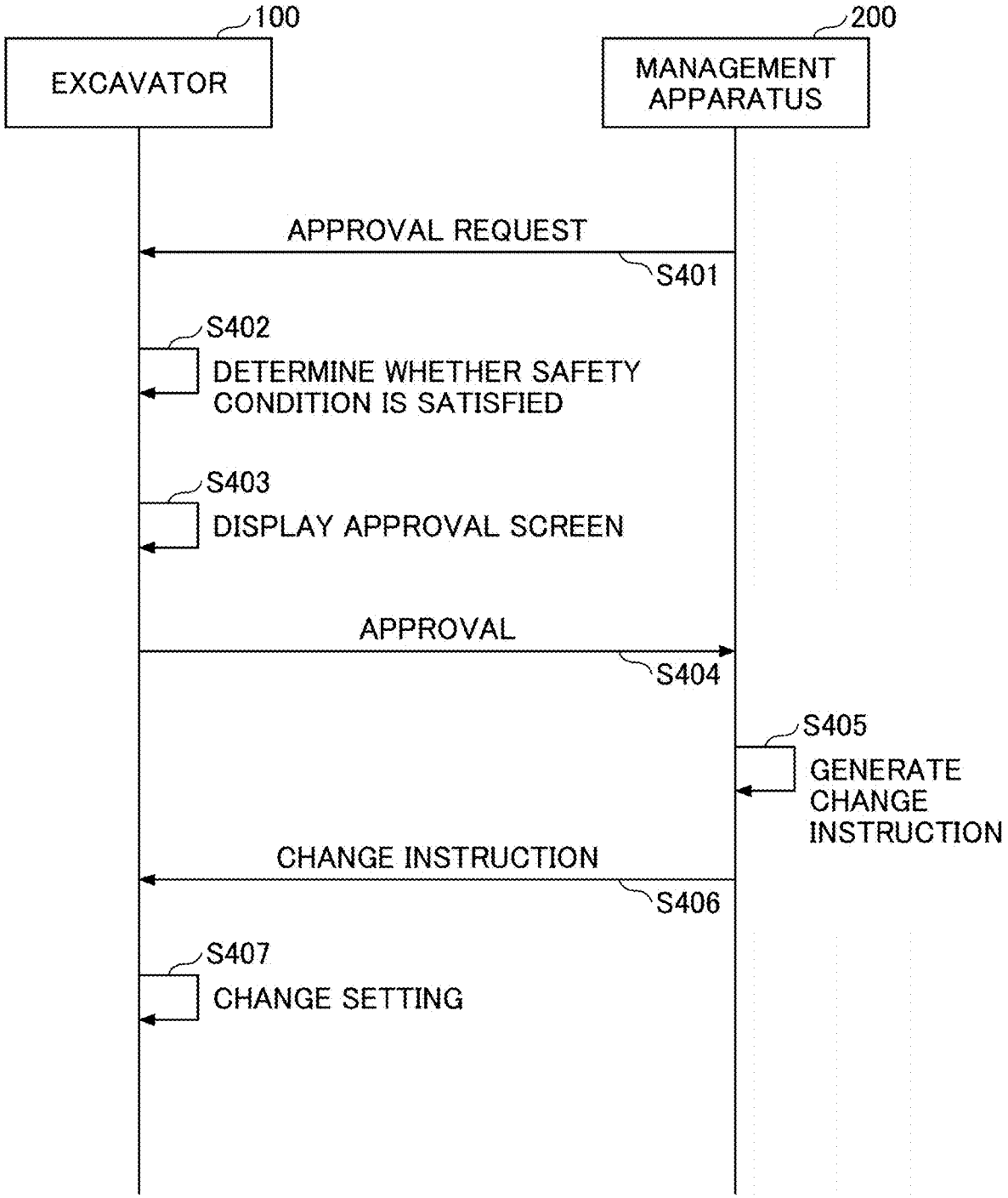
FIG. 4 is a sequence diagram illustrating the operation of an excavator management system.

Next, the operation of the management system SYS of the present embodiment will be described with reference to FIG. 4. FIG. 4 is a sequence diagram for explaining the operation of the management system of the excavator.

In the management system SYS of the present embodiment, the management apparatus 200 transmits, by the communication control part 210, an approval request to the excavator 100 for requesting approval for changing the settings of the manager item (step S401).

The timing of transmitting the approval request from the management apparatus 200 to the excavator 100 may be determined, for example, by a call between the operator of the excavator 100 and the service person using the management apparatus 200. Specifically, the approval request is transmitted from the management apparatus 200 to the excavator 100 when the operator and the service person mutually agree to change the settings of the manager item and the service person performs an operation to transmit the approval request to the excavator 100 in the management apparatus 200.

When the input receiving part 31 receives the approval notification, the excavator 100 determines whether the excavator satisfies the safety condition by the safety condition determining part 33 (step S402).

When the excavator 100 satisfies the safety condition, the excavator 100 causes, by the display control part 32, the display device 40 to display an approval screen (step S403).

At this time, the main screen may be displayed on the display device 40, and the display control part 32 may receive the approval request and cause the main screen displayed on the display device 40 to transition to the approval screen.

Subsequently, when the input receiving part 31 receives an operation of approval on the approval screen, the excavator 100 transmits an approval notification indicating that the change of the setting of the manager item is approved to the management apparatus 200 by the notification output part 35 (step S404).

When the management apparatus 200 receives the approval notification by the communication control part 210, the change instructing part 220 generates a change instruction instructing the change of the item value of the approved manager item (step S405), and the communication control part 210 transmits the change instruction to the excavator 100 (step S406).

When the input receiving part 31 receives a change instruction instructing the change of the setting of the manager item, the excavator 100 changes the item value (parameter) of the manager item according to the change instruction by the setting changing part 34 (step S407).

Figure 5:
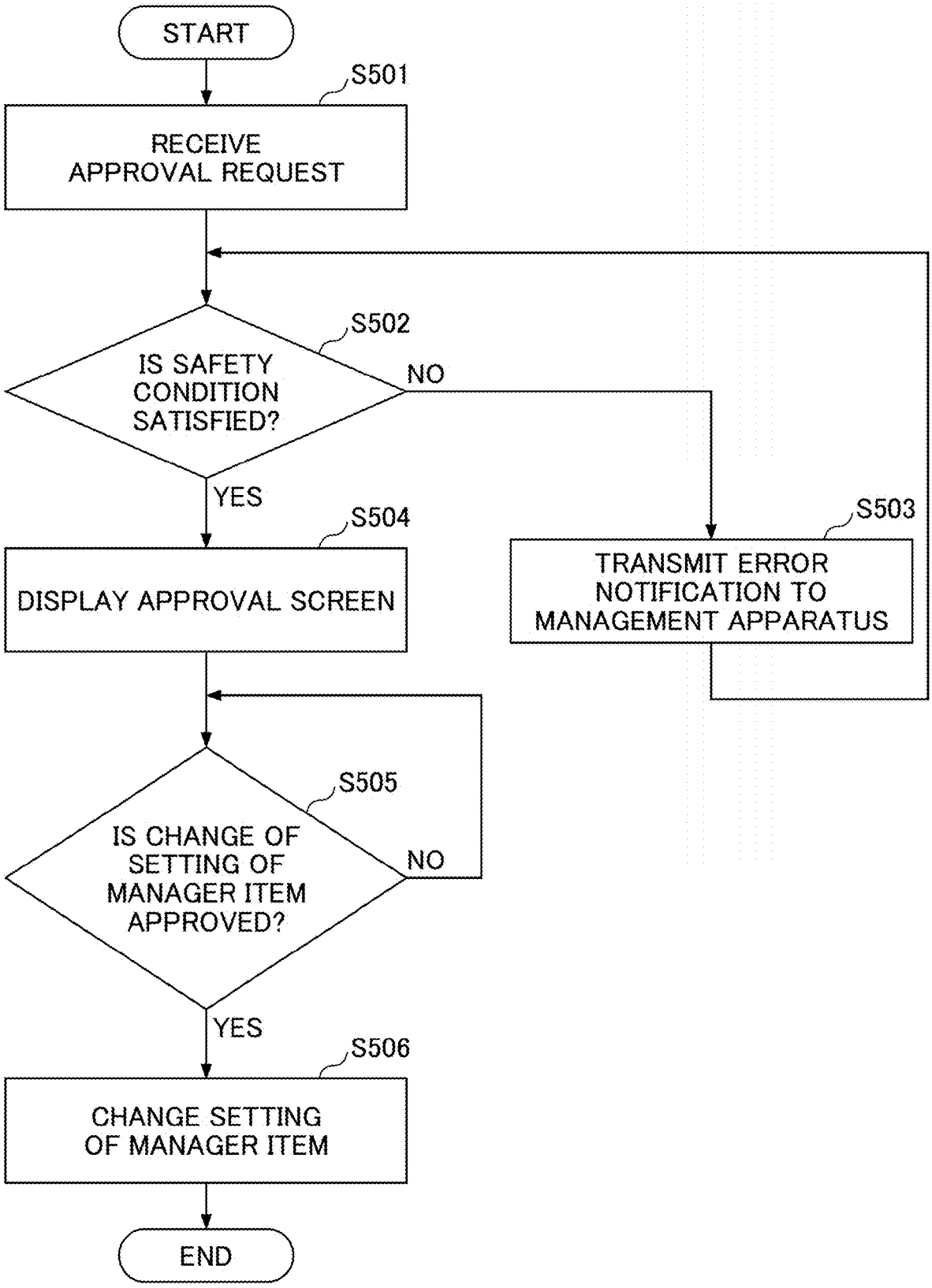
FIG. 5 is a flowchart illustrating the operation of an excavator.

Next, the operation of the excavator 100 will be described in more detail with reference to FIG. 5. FIG. 5 is a flowchart for explaining the operation of the excavator.

In the present embodiment, the processing of FIG. 5 is executed when the excavator 100 is in the key-on state. When the excavator 100 is in the key-on state, power is supplied to the display device 40 and power is supplied to the controller 30.

The excavator 100 of the present embodiment receives an approval request for a change in the setting of the manager item from the management apparatus 200 by the input receiving part 31 (step S501).

Subsequently, the excavator 100 determines, by the safety condition determining part 33, whether the state of the excavator 100 satisfies the safety condition (step S502).

When it is determined in step S502 that the safety condition is not satisfied, the excavator 100 transmits, by the notification output part 35, an error notification indicating that the safety condition is not satisfied to the management apparatus 200 (step S503), and the process returns to step S502.

When it is determined in step S502 that the safety condition is satisfied, the excavator 100 causes, by the display control part 32, the display device 40 to display an approval screen for approving the change in the setting of the manager item (step S504).

Subsequently, the excavator 100 determines whether the input receiving part 31 has received the operation to approve the change of the setting of the manager item on the approval screen (step S505). If the operation to approve is not received in step S505, the excavator 100 returns to step S505.

If the operation to approve is received in step S505, the excavator 100 receives the change instruction transmitted from the management apparatus 200 by the input receiving part 31, and changes the setting of the manager item according to the setting instruction, by the setting changing part 34 (step S506).

Specifically, the setting changing part 34 identifies the manager item based on the manager item to be changed included in the change instruction, and updates the item value (parameter) associated with the identified manager item to the item value (parameter) after change included in the change instruction.

As described above, in the present embodiment, for the manager item for which the operator of the excavator 100 is prohibited from changing the setting, the setting can be changed by remote operation from the management apparatus 200.

Therefore, according to the present embodiment, it is not necessary for the service person to go to the work site of the excavator 100 in order to change the setting of the manager item, and the service person can change the setting of the manager item from the office or the like where the management apparatus 200 is arranged.

Note that the excavator 100 of the present embodiment monitors whether the excavator 100 maintains a state in which the safety condition is satisfied even while changing the item value (parameter) of the manager item, for example. That is, the excavator 100 determines, by the safety condition determining part 33, whether the safety condition is satisfied even during the process of FIG. 5.

When the safety condition is no longer satisfied, the excavator 100 discontinues the process of changing the item value (parameter) of the manager item. That is, if an operation that does not satisfy the safety condition is performed during the parameter change (for example, engine ON, etc.), the excavator 100 stops the process illustrated in FIG. 5. In the present embodiment, the safety can be improved by monitoring the state of the excavator 100 as described above.

Next, a display example on the display device 40 of the excavator 100 according to the present embodiment will be described with reference to FIGS. 6A, 6B, and 6C.

Figure 6A:
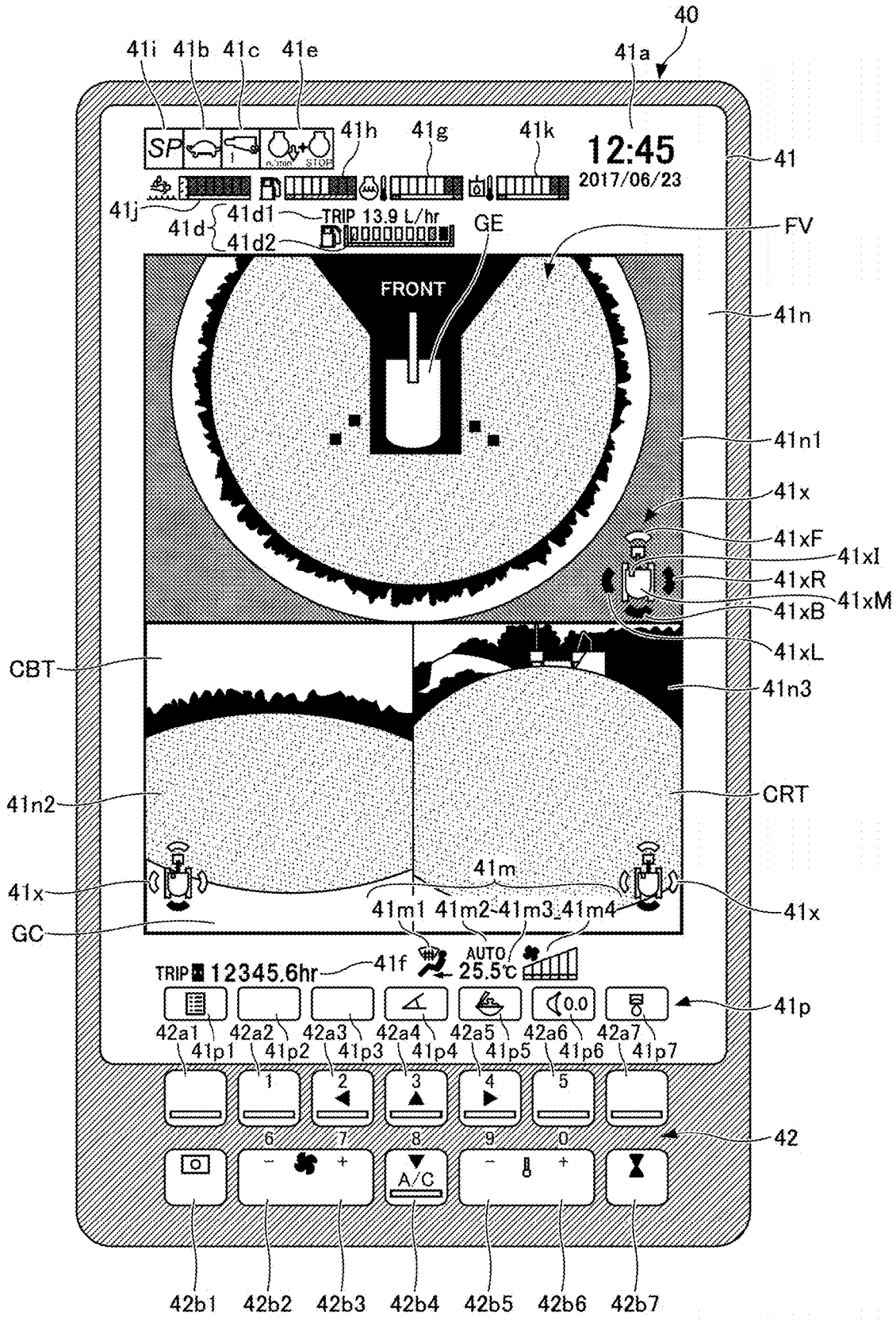
FIG. 6A is a first diagram illustrating a display example of an excavator.

FIG. 6A is a first diagram illustrating a display example of the excavator. The screen illustrated in FIG. 6A is an example of the main screen of the excavator 100. The main screen illustrated in FIG. 6A may be displayed on the display device 40 before the approval screen is displayed in step S403 of FIG. 4.

The main screen illustrated in FIG. 6A illustrates a state in which a bird's eye image, a rear image, and a right image are displayed.

First, the image display part 41 will be described. As illustrated in FIG. 6A, the image display part 41 includes a date and time display area 41*a*, a travel mode display area 41*b*, an attachment display area 41*c*, a fuel mileage display area 41*d*, an engine control state display area 41*e*, an engine operating time display area 41*f*, a cooling water temperature display area 41*g*, a fuel remaining amount display area 41*h*, a rotation speed mode display area 41*i*, a urea water remaining amount display area 41*j*, a hydraulic oil temperature display area 41*k*, an air conditioner operating state display area 41*m*, an image display area 41*n*, and a menu display area 41*p*.

The travel mode display area 41*b*, the attachment display area 41*c*, the engine control state display area 41*e*, the rotation speed mode display area 41*i*, and the air conditioner operating state display area 41*m* are areas for displaying setting state information that is information about the setting state of the excavator 100. The fuel mileage display area 41*d*, the engine operating time display area 41*f*, the cooling water temperature display area 41*g*, the fuel remaining amount display area 41*h*, the urea water remaining amount display area 41*j*, and the hydraulic oil temperature display area 41*k* are areas for displaying operating state information that is information about the operating state of the excavator 100.

Specifically, the date and time display area 41*a* is an area for displaying the current date and time. The travel mode display area 41*b* is an area for displaying the current travel mode. The attachment display area 41*c* is an area for displaying an image representing the currently attached attachment. The fuel mileage display area 41*d* is an area for displaying fuel mileage information calculated by the controller 30. The fuel mileage display area 41*d* includes an average fuel mileage display area 41*d*1 for displaying lifetime average fuel mileage or section average fuel mileage, and an instantaneous fuel mileage display area 41*d*2 for displaying instantaneous fuel mileage.

The engine control state display area 41*e* is an area for displaying the control state of the engine 11. The engine operating time display area 41*f* is an area for displaying the accumulated operating time of the engine 11. The cooling water temperature display area 41*g* is an area for displaying the current temperature state of the engine cooling water. The fuel remaining amount display area 41*h* is an area for displaying the remaining amount of fuel stored in the fuel tank. The rotation speed mode display area 41*i* is an area for displaying in an image the current rotation speed mode set by the engine rotation speed adjustment dial 75. The urea water remaining amount display area 41*j* is an area for displaying in an image the remaining amount of urea water stored in the urea water tank. The hydraulic oil temperature display area 41*k* is an area for displaying the temperature state of the hydraulic oil in the hydraulic oil tank.

The air conditioner operating state display area 41*m* includes an outlet display area 41*m*1 for displaying the current position of the outlet, an operation mode display area 41*m*2 for displaying the current operation mode, a temperature display area 41*m*3 for displaying the current set temperature, and an air volume display area 41*m*4 for displaying the current set air volume.

The image display area 41*n* is an area for displaying an image captured by the imaging device S6. In the example of FIG. 6A, the image display area 41*n* displays the bird's eye image FV, the rear image CBT, and the right image CRT. The bird's eye image FV is a virtual viewpoint image generated by the control part 40*a*, and is generated based on images acquired by the rear camera S6B, the left camera S6L, and the right camera S6R, respectively. The excavator figure GE corresponding to the excavator 100 is arranged at the center of the bird's eye image FV. This is so that the operator can intuitively identify the positional relationship between the excavator 100 and objects existing around the excavator 100.

The rear image CBT is an image projecting the space behind the excavator 100, and includes a counterweight image GC. The rear image CBT is a visual point image generated by the control part 40*a*, and is generated based on the image acquired by the rear camera S6B. The right image CRT is an image projecting the space on the right side of the excavator 100, and is generated based on the image acquired by the right camera S6R.

The image display area 41*n* includes a first image display area 41*n*1 located at the top, a second image display area 41*n*2 and a third image display area 41*n*3, both of which are positioned at the bottom. In the example of FIG. 6A, the bird's eye image FV is arranged in the first image display area 41*n*1, the rear image CBT is arranged in the second image display area 41*n*2, and the right image CRT is arranged in the third image display area 41*n*3. However, in the image display area 41*n*, the bird's eye image FV may be arranged in the second image display area 41*n*2, and the rear image CBT may be arranged in the first image display area 41*n*1.

In the example of FIG. 6A, the bird's eye image FV, the rear image CBT, and the right image CRT are arranged vertically adjacent to each other, but these images may be arranged at intervals. In the example of FIG. 6A, the image display area 41*n* is a vertically long area, but the image display area 41*n* may be a horizontally long area. When the image display area 41*n* is a horizontally long area, in the image display area 41*n*, the bird's eye image FV may be arranged as the first image display area 41*n*1 on the left side, and the rear image CBT and the right image CRT may be arranged as the second image display area 41*n*2 and the second image display area 41*n*2 on the right side. In this case, the images may be arranged at intervals on the left and right sides, or the positions of the bird's eye image FV and the rear image CBT may be interchanged.

Further, in the present embodiment, an icon image 41*x* is displayed in each of the first image display area 41*n*1, the second image display area 41*n*2, and the third image display area 41*n*3. The icon image 41*x* is an image representing the relative relationship between the position of the imaging device S6 and the orientation of the attachment of the upper turning body 3.

The icon image 41*x* of the present embodiment includes an image 41*x*M of the excavator 100, an image 41*x*F indicating the front of the excavator 100, and an image 41*x*B indicating the rear of the excavator 100. The icon image 41*x* includes an image 41*x*L indicating the left side of the excavator 100, an image 41*x*R indicating the right side of the excavator 100, and an image 41*x*I indicating the interior of the cabin 10.

The images 41*x*F, 41*x*B, 41*x*L, 41*x*R, and 41*x*I correspond to the front camera S6F for capturing the front of the excavator 100, the rear camera S6B for capturing the rear of the excavator 100, the left camera S6L for capturing the left side of the excavator 100, and the right camera S6R for capturing the right side of the excavator 100, respectively. The image 41*x*I corresponds to a camera inside the cabin 10.

In the present embodiment, when an image associated with each camera is selected in the icon image 41*x*, image data captured by the camera corresponding to the selected image is displayed in the image display area 41*n*.

In the example of FIG. 6A, in the first image display area 41*n*1, the display modes of the images 41*x*B, 41*x*L, and 41*x*R are different from the display modes of the images 41*x*F and 41*x*I. Therefore, it can be seen that the first image display area 41*n*1 displays a bird's eye image represented by image data synthesized from image data captured by the rear camera S6B, the left camera S6L, and the right camera S6R corresponding to the images 41*x*B, 41*x*L, and 41*x*R, respectively.

Further, in the second image display area 41*n*2, the display mode of the image 41*x*B is different from the display mode of the images 41*x*F, 41*x*L, 41*x*R, and 41*x*I. Therefore, it can be seen that the image represented by the image data captured by the rear camera S6B corresponding to the image 41*x*B is displayed in the second image display area 41*n*2. Moreover, in the third image display area 41*n*3, the display mode of the image 41*x*R is different from the display mode of the images 41*x*F, 41*x*L, 41*x*B, and 41*x*I. Therefore, it can be seen that the image represented by the image data captured by the right camera S6R corresponding to the image 41*x*R is displayed in the third image display area 41*n*3.

The menu display area 41*p* has tabs 41*p*1 to 41*p*7. In the example illustrated in FIG. 6A, tabs 41*p*1 to 41*p*7 are arranged at the lowermost portion of the image display part 41 at intervals from each other on the left and right sides. Icons for displaying various kinds of information are displayed on the tabs 41*p*1 to 41*p*7.

The tab 41*p*1 displays a menu detail item icon for displaying a menu detail item. When tab 41*p*1 is selected by the operator, the icons displayed on the tab 41*p*2 to 41*p*7 are switched to the icons associated with the menu detail item.

The tab 41*p*4 displays an icon for displaying information relating to the digital level. When the tab 41*p*4 is selected by the operator, the rear image CBT is switched to a screen for displaying information relating to the digital level. However, a screen for displaying information relating to the digital level may be displayed by being superimposed the rear image CBT or reducing the rear image CBT. Also, the bird's eye image FV may be switched to a screen for displaying information relating to the digital level, or a screen for displaying information relating to the digital level may be displayed by being superimposed on the bird's eye image FV or reducing the bird's eye image FV.

In the tab 41*p*6, an icon for displaying information relating to computerized construction is displayed. When the operator selects the tab 41*p*6, the rear image CBT is switched to a screen indicating information relating to computerized construction. However, a screen indicating information relating to computerized construction may be displayed by being superimposed on the rear image CBT or reducing the rear image CBT. Also, the bird's eye image FV may be switched to a screen indicating information relating to computerized construction, and a screen indicating information relating to computerized construction may be displayed by being superimposed on the bird's eye image FV or reducing the bird's eye image FV.

An icon for displaying information relating to the crane mode is displayed on the tab 41*p*7. When the operator selects the tab 41*p*7, the rear image CBT is switched to a screen indicating information relating to the crane mode. However, a screen indicating information relating to the crane mode may be displayed by being superimposed on the rear image CBT or reducing the rear image CBT. The bird's eye image FV may be switched to a screen indicating information relating to the crane mode, or a screen indicating information relating to the crane mode may be displayed by being superimposed on the bird's eye image FV or reducing the bird's eye image FV.

No icon is displayed on the tabs 41*p*2, 41*p*3, and 41*p*5. Therefore, even if the tabs 41*p*2, 41*p*3, and 41*p*5 are operated by the operator, no change occurs in the image displayed on the image display part 41.

The icons displayed on the tabs 41*p*1 to 41*p*7 are not limited to the example described above, and icons for displaying other information may be displayed.

Next, the operation part 42 will be described. As illustrated in FIG. 6A, the operation part 42 includes one or a plurality of button switches for performing selection of the tabs 41*p*1 to 41*p*7, setting input, or the like by the operator. In the example illustrated in FIG. 6A, the operation part 42 includes seven switches 42*a*1 to 42*a*7 arranged on the upper stage and seven switches 42*b*1 to 42*b*7 arranged on the lower stage. The switches 42*b*1 to 42*b*7 are arranged below the switches 42*a*1 to 42*a*7, respectively. However, the number, form, and arrangement of the switches of the operation part 42 are not limited to the example described above, and may be a form in which the functions of a plurality of button switches are integrated by a jog wheel, a jog switch, or the like, or may be a form in which the operation part 42 is separate from the display device 40. Alternatively, the tabs 41*p*1 to 41*p*7 may be directly operated by a touch panel in which the image display part 41 and the operation part 42 are integrated.

The switches 42*a*1 to 42*a*7 are arranged below the tabs 41*p*1 to 41*p*7 and correspond to the tabs 41*p*1 to 41*p*7, respectively, and function as switches for selecting the tabs 41*p*1 to 41*p*7, respectively. Because the switches 42*a*1 to 42*a*7 are arranged below the tabs 41*p*1 to 41*p*7 and correspond to the tabs 41*p*1 to 41*p*7, respectively, the operator can intuitively select the tabs 41*p*1 to 41*p*7.

The switch 42*b*1 switches the captured image displayed in the image display area 41*n*. Each time the switch 42*b*1 is operated, the captured image displayed in the first image display area 41*n*1 of the image display area 41*n* is switched between, for example, a rear image, a left image, a right image, and a bird's eye image. Each time the switch 42*b*1 is operated, the captured image displayed in the second image display area 41*n*2 of the image display area 41*n* may be switched between, for example, a rear image, a left image, a right image, and a bird's eye image.

Each time the switch 42*b*1 is operated, the captured image displayed in the first image display area 41*n*1 of the image display area 41*n*, the captured image displayed in the second image display area 41*n*2, and the captured image displayed in the third image display area 41*n*3 may be switched.

As described above, the switch 42*b*1 as the operation part 42 may switch the screens displayed in each of the first image display area 41*n*1, the second image display area 41*n*2, and the third image display area 41*n*3. A switch for switching the screens displayed in the second image display area 41*n*2 and the third image display area 41*n*3 may be provided separately.

The switches 42*b*2 and 42*b*3 are switches for adjusting the air volume of the air conditioner. In the example illustrated in FIG. 6A, the air volume of the air conditioner decreases when the switch 42*b*2 is operated, and increases when the switch 42*b*3 is operated.

The switch 42*b*4 is a switch for switching either of the cooling function or heating function on or off. In the example illustrated in FIG. 6A, each time the switch 42*b*4 is operated, the cooling function or heating function is alternately switched between ON and OFF.

The switches 42*b*5 and 42*b*6 are switches for adjusting the set temperature of the air conditioner. In the example illustrated in FIG. 6A, the set temperature is lowered when the switch 42*b*5 is operated and is raised when the switch 42*b*6 is operated.

The switch 42*b*7 is a switch capable of switching the display of the engine operating time display area 41*f*.

The switches 42*a*2 to 42*a*6 and 42*b*2 to 42*b*6 are configured to be capable of inputting respective switches or numbers displayed near the switches. The switches 42*a*3, 42*a*4, 42*a*5, and 42*b*4 are configured to be capable of moving a cursor to the left, up, right, and down, when the cursor is displayed on the menu screen.

The functions provided to the switches 42*a*1 to 42*a*7 and 42*b*1 to 42*b*7 are only examples, and the switches may be configured to be capable of executing other functions.

In the image display area 41*n*, a bird's eye image FV is displayed without having the size thereof changed before and after the tab 41*p*1 is selected. The visibility is not degraded when the operator checks the surroundings of the excavator 100.

Figure 6B:
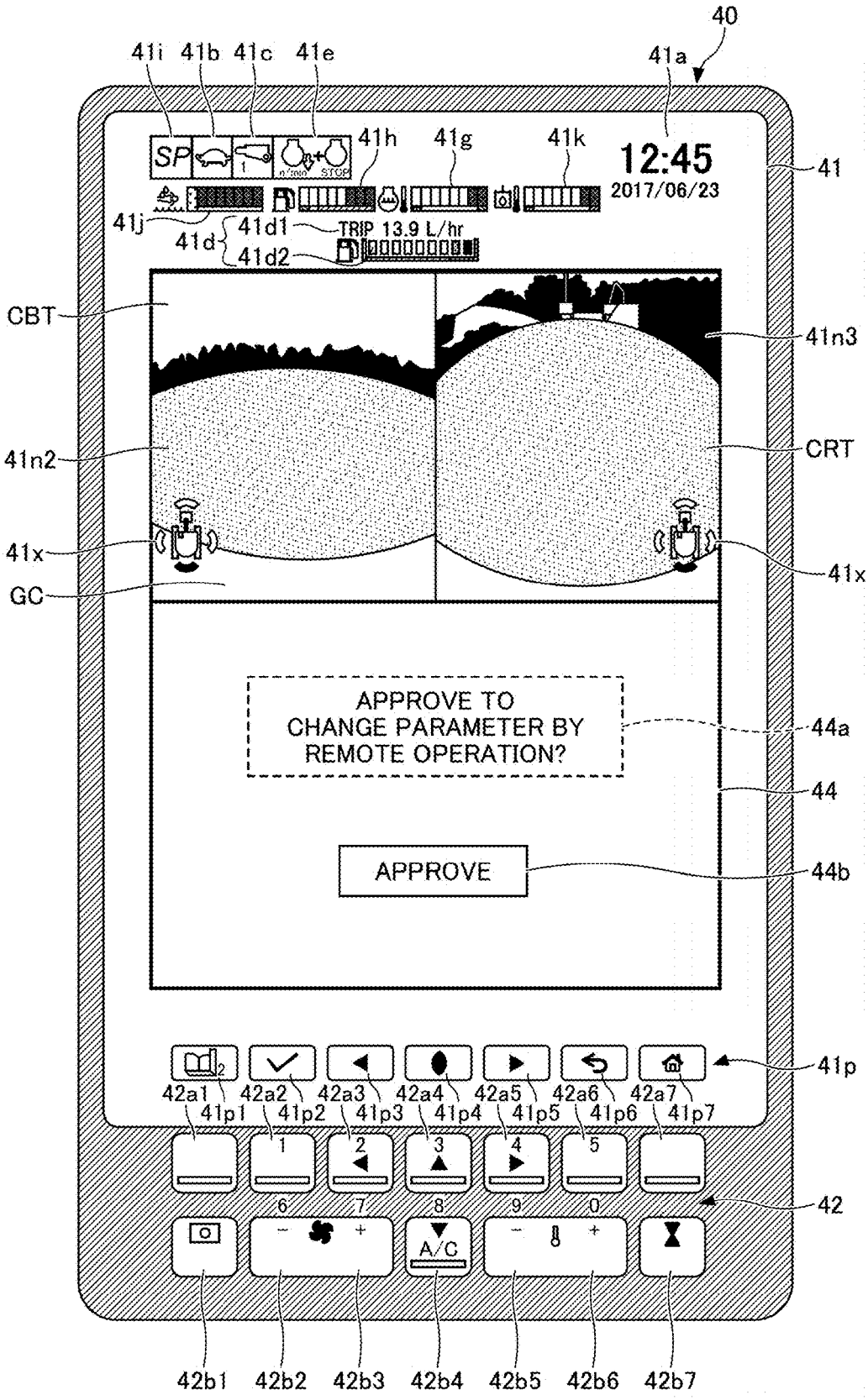
FIG. 6B is a second diagram illustrating a display example of an excavator.

In the excavator 100 of the present embodiment, when the main screen illustrated in FIG. 6A is displayed on the display device 40 and an approval request is received from the management apparatus 200, the main screen transitions to the approval screen illustrated in FIG. 6B.

FIG. 6B is a second diagram illustrating a display example of the excavator. The screen illustrated in FIG. 6B is an example of the approval screen of the excavator 100 and is displayed on the display device 40 in step S403 of FIG. 4.

In the approval screen illustrated in FIG. 6B, the rear image CBT and the right image CRT are displayed in the first image display area 41*n*1, and the second image display area 41*n*2 and the third image display area 41*n*3 are switched to the display area 44.

The display area 44 may display a message 44*a* and an operation button 44*b*. The message 44*a* is for asking the operator of the excavator 100 whether to approve the change of the item value (parameter) of the manager item by remote operation. The operation button 44*b* is an operation button for the operator of the excavator 100 to transmit an approval notification indicating that the change of the parameter by remote operation has been approved to the management apparatus 200.

When an operation to select the operation button 44*b* is performed on the approval screen illustrated in FIG. 6B, the approval notification is transmitted from the excavator 100 to the management apparatus 200.

Figure 6C:
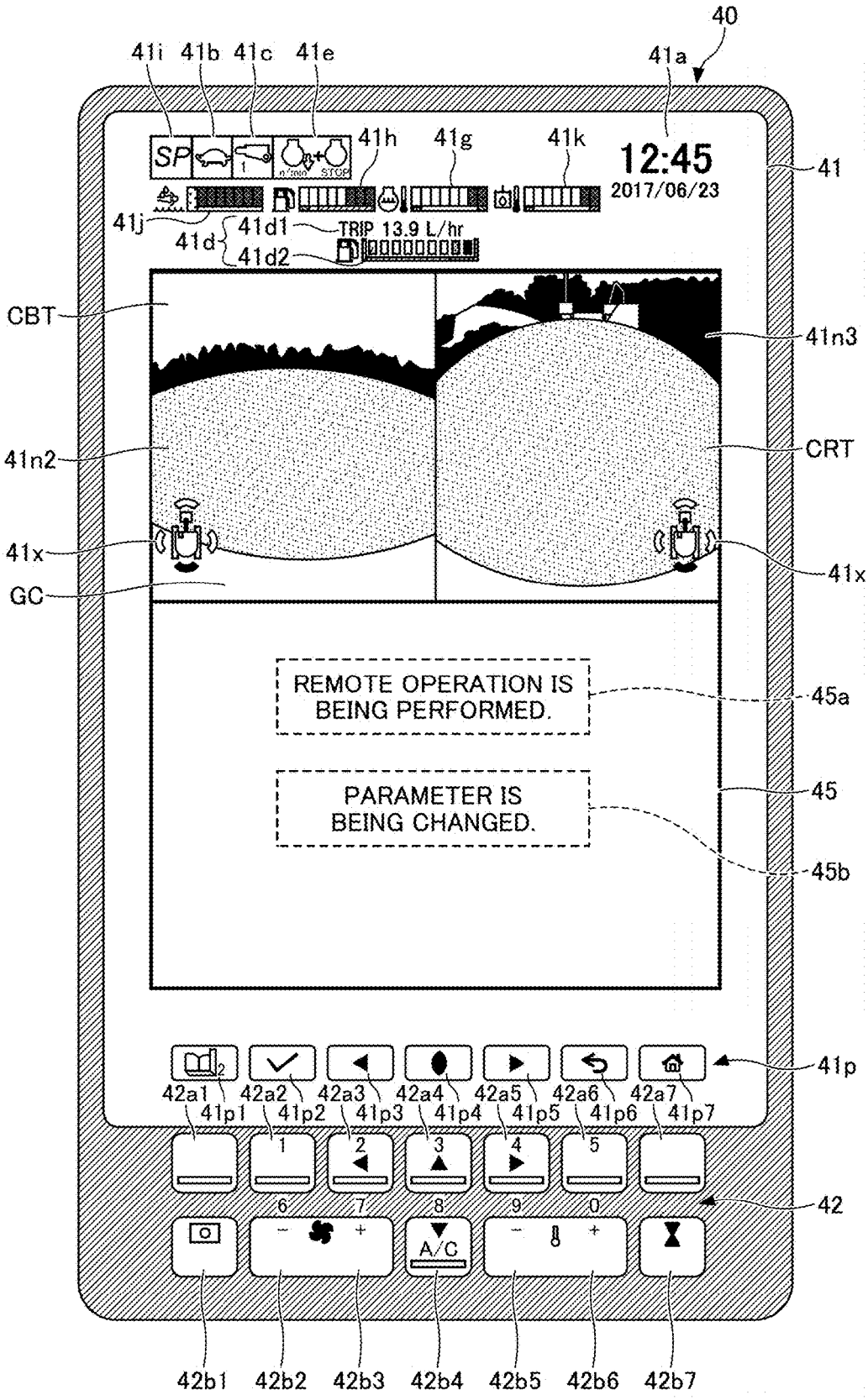
FIG. 6C is a third diagram illustrating a display example of an excavator.

FIG. 6C is a third diagram illustrating a display example of the excavator. The screen illustrated in FIG. 6C is an example of a screen displayed on the display device 40 during the change of the parameter by remote operation, and may be displayed on the display device 40 in step S407 of FIG. 4.

In the screen illustrated in FIG. 6C, the rear image CBT and the right image CRT are displayed in the first image display area 41*n*1, and the second image display area 41*n*2 and the third image display area 41*n*3 are switched to the display area 45.

Messages 45*a* and 45*b* may be displayed in the display area 45. The message 45*a* is a message indicating to the operator of the excavator 100 that a remote operation is being performed by the management apparatus 200. The message 45*b* is a message indicating that the excavator 100 is in the process of changing the item value (parameter) of the manager item in response to the change instruction received from the management apparatus 200.

In the present embodiment, the operator of the excavator 100 can be made aware that the parameter is being changed by the remote operation, and the operator can be made to maintain a state that satisfies the safety conditions.

Further, in the present embodiment, because the message indicating that the remote operation is being performed by the management apparatus 200 and the message indicating that the parameter is being changed are displayed together with the captured images (rear image and right image), the visibility is not degraded when the operator checks the surroundings of the excavator 100.

When the parameter change is completed, the excavator 100 of the present embodiment may cause the screen illustrated in FIG. 6C to transition to a change completion screen indicating that the parameter change is completed.

The excavator 100 of the present embodiment may cause the change completion screen to transition to the main screen illustrated in FIG. 6A, for example, when the engine 11 is turned on after the parameter change is completed.

According to an aspect of the present invention, the setting can be easily changed.

Although the embodiment of the present invention has been described above, the above contents are not intended to limit the contents of the present invention, and various modifications and improvements are possible within the scope of the present invention.

What is claimed is:

1. An excavator comprising:

an upper turning body;

a lower traveling body; and a hardware processor configured to determine whether to permit a parameter relating to control of the excavator to be remotely changed by a remote operation from a management apparatus managing the excavator, and permit the parameter to be remotely changed in response to determining to permit the parameter to be remotely changed.

2. The excavator according to claim 1, wherein the hardware processor is further configured to permit the parameter to be remotely changed when a state of the excavator satisfies a safety condition.

3. The excavator according to claim 2, wherein the safety condition includes at least one of a state in which an engine of the excavator is turned off, a state in which an operation by an operation device of the excavator is disabled, or a state in which an operation lever included in the operation device is in neutral.

4. The excavator according to claim 1, wherein the hardware processor is further configured to display, on a display, an approval screen for giving an approval for remotely changing the parameter, upon receiving, from the management apparatus, a request for the approval for remotely changing the parameter, and determine to permit the parameter to be remotely changed in response to the approval being given on the approval screen.

5. The excavator according to claim 1, wherein the hardware processor is further configured to, while the parameter is being remotely changed, display information indicating that the parameter is being remotely changed on a display.

6. The excavator according to claim 5, wherein the hardware processor is further configured to display the information and an image captured by an imaging device on a same screen on the display.

7. The excavator according to claim 1, wherein the hardware processor is configured to halt a process of remotely changing the parameter when the excavator enters a state in which a safety condition is not satisfied, while the parameter is being remotely changed.

8. The excavator according to claim 1, wherein the hardware processor is further configured to receive a request for an approval for remotely changing the parameter from the management apparatus, determine whether the approval is given in response to receiving the request, and transmit a notification indicating that the approval is given to the management apparatus in response to determining that the approval is given.

9. The excavator according to claim 8, wherein the hardware processor is further configured to display a screen for giving the approval on a display in response to receiving the request, and transmit the notification to the management apparatus in response to receiving an operation of the approval on the screen.

10. The excavator according to claim 9, wherein the screen includes a message asking whether to give the approval and an operation button for transmitting the notification to the management apparatus.

11. The excavator according to claim 8, wherein the hardware processor is further configured to change the parameter in response to receiving an instruction to change the parameter from the management apparatus, the instruction being generated by the management apparatus in response to the notification received from the excavator.

12. The excavator according to claim 1, wherein the hardware processor is further configured to monitor whether the excavator keeps satisfying a safety condition while the parameter is being remotely changed, and halt a process of remotely changing the parameter in response to determining that the excavator no longer satisfies the safety condition.

13. The excavator according to claim 1, wherein the hardware processor is further configured to notify an operator of the excavator of completion of remotely changing the parameter before the excavator starts to be operated.

14. The excavator according to claim 1, wherein the parameter includes at least one of a maximum rotation speed of an engine of the excavator, a minimum rotation speed of the engine in an idling state, a rotation speed of the engine when an idle mode is selected, a degree of luminance of a display, a speed balance between a turning motion when a lever operation to turn the upper turning body is performed and a boom-up operation when a lever operation to raise a boom of the excavator is performed, or a function to display a setting screen related to a specific setting.

* * * * *